US012564761B2

(12) United States Patent
Demelo

(10) Patent No.: US 12,564,761 B2
(45) Date of Patent: Mar. 3, 2026

(54) DEVICE FOR FACIAL AND NECK MUSCLES STIMULATION

(71) Applicant: Fatima L. Demelo, New York, NY (US)

(72) Inventor: Fatima L. Demelo, New York, NY (US)

(73) Assignee: Fatima L. Demelo, New York, NY (US)

( * ) Notice: Subject to any disclaimer, the term of this patent is extended or adjusted under 35 U.S.C. 154(b) by 0 days.

(21) Appl. No.: 18/516,409

(22) Filed: Nov. 21, 2023

(65) Prior Publication Data

US 2024/0082632 A1 Mar. 14, 2024

Related U.S. Application Data

(63) Continuation of application No. 16/988,365, filed on Aug. 7, 2020, now Pat. No. 11,857,835.
(Continued)

(51) Int. Cl.
*A63B 23/03* (2006.01)
*A63B 1/00* (2006.01)
(Continued)

(52) U.S. Cl.
CPC ..... *A63B 23/032* (2013.01); *A63B 1/00* (2013.01); *A63B 21/1681* (2013.01);
(Continued)

(58) Field of Classification Search
CPC ..... A63B 23/032; A63B 23/025; A63B 23/03; A63B 21/4035; A63B 1/00;
(Continued)

(56) References Cited

U.S. PATENT DOCUMENTS 480,357 A * 8/1892 Worthen ..... A61B 1/24 269/254 R
554,844 A * 2/1896 Stienbarger ..... A61C 3/16 433/154
(Continued)

FOREIGN PATENT DOCUMENTS

CN 105662536 A 6/2016
DE 10139688 A1 * 8/2002 ..... A63B 21/0552
GB 2385282 A 8/2003

OTHER PUBLICATIONS

Translation of DE-10139688-A1 (Year: 2002).*

*Primary Examiner* — Megan Anderson
*Assistant Examiner* — Catrina A Letterman
(74) *Attorney, Agent, or Firm* — Chiesa Shahinian & Giantomasi PC

(57) ABSTRACT

A device configured to exercise facial and neck muscles and related methods are provided. The device operates by applying static and/or dynamic external forces to the muscles of the modiolus area of the face and related ligaments. The device includes a pair of bars that may be connected by a rotatory connection or by an expandable horizontal connection, each having a proximal and distal end. The proximal end of each bar includes a modiolus holder. The modiolus holders are shaped to partially fit within the user's mouth, and when fit to the modiolus area by the separation of the bars, brings the modiolus holders in tight contact with the modiolus area. This movement secures the insertions of the muscles attached at the modiolus, allowing these muscles to be stretched, therefore creating resistance to their contractions.

10 Claims, 16 Drawing Sheets

Related U.S. Application Data

(60) Provisional application No. 62/883,824, filed on Aug. 7, 2019.

(51) Int. Cl.
*A63B 21/00* (2006.01)
*A63B 21/16* (2006.01)
*A63B 23/025* (2006.01)
*A63B 71/06* (2006.01)

(52) U.S. Cl.
CPC ..... *A63B 21/4035* (2015.10); *A63B 71/0622* (2013.01); *A63B 23/025* (2013.01); *A63B 23/03* (2013.01); *A63B 2071/0658* (2013.01); *A63B 2220/56* (2013.01); *A63B 2225/093* (2013.01)

(58) Field of Classification Search
CPC ..... A63B 21/1681; A63B 71/0622; A63B 2071/0658; A63B 2220/56; A63B 2225/093; A63B 21/159; A63B 2225/20; A63B 71/0054; A63B 2071/0675; A63B 2208/0233; A63B 2209/08; A63B 2209/18; A63B 2210/50; A63B 2220/51; A63B 2220/80; A63B 2220/833; A63B 2225/50; A61C 5/90; A61C 7/04; A61C 13/12; A61C 3/00; A61C 3/14; A61C 3/16; A61C 1/24
USPC ..... 433/140
See application file for complete search history.

(56) References Cited

U.S. PATENT DOCUMENTS

| | | | | |
|---|---|---|---|---|
| 1,060,242 | A * | 4/1913 | Feldman | A61C 3/14 433/159 |
| 1,363,534 | A * | 12/1920 | Rogers | A61C 7/00 606/204.15 |
| 2,075,534 | A * | 3/1937 | Mccormack | A61B 1/24 600/219 |
| 3,813,096 | A * | 5/1974 | Welch | A63B 23/032 482/11 |
| 4,280,696 | A * | 7/1981 | Ramon | A63B 23/032 482/122 |
| 5,097,820 | A | 3/1992 | Shulman et al. | |
| 5,577,983 | A * | 11/1996 | Fraser | A63B 23/032 433/140 |
| 7,662,066 | B2 | 2/2010 | Ferrara | |
| 12,102,500 | B1 * | 10/2024 | Madan | A61C 7/02 |
| 2004/0166993 | A1 * | 8/2004 | Tiberio | A63B 23/032 482/124 |
| 2006/0122036 | A1 * | 6/2006 | Ferrara | A63B 21/02 482/121 |
| 2007/0012319 | A1 * | 1/2007 | Frascati | A63B 23/032 128/861 |
| 2007/0037665 | A1 | 2/2007 | Robbins et al. | |
| 2008/0103026 | A1 * | 5/2008 | An | A63B 21/023 482/49 |
| 2009/0239721 | A1 * | 9/2009 | Bisson | A63B 23/03533 482/126 |
| 2013/0260963 | A1 | 10/2013 | Takashi | |
| 2020/0121924 | A1 * | 4/2020 | Sama | A61B 5/038 |

* cited by examiner

150

DEVICE FOR FACIAL AND NECK MUSCLES STIMULATION

CROSS-REFERENCE TO RELATED APPLICATION

This application is a Continuation Application of prior-filed U.S. patent application Ser. No. 16/988,365, filed on Aug. 7, 2020, which claims the benefit of prior-filed U.S. Provisional Application Ser. No. 62/883,824, filed on Aug. 7, 2019, the entirety of both of which are herein incorporated by reference.

FIELD OF INVENTION

The present invention relates to devices for facial and neck muscle exercise, and in particular to a device configured to allow for control and exercise of muscles in the modiolus area of the face and surrounding areas thereof.

BACKGROUND OF THE INVENTION

Like other muscles in human's body, facial muscles are subject to sarcopenia, i.e., age-related muscle tissue decline. Sarcopenia is known to be a multifactorial condition affected by a plurality of interconnected contributing factors, including, for example, accumulating DNA damage, neurological decline, inflammation, chronic illnesses, inherited conditions, poor nutrition, mitochondrial decline, and lack of physical activity. Sarcopenia typically starts to manifest around age 30 and typically progresses with a 1% loss of muscular mass each year thereafter. Facial sarcopenia can be accelerated by tooth loss, the natural wearing out of dentition and by certain malocclusion problems. In these cases, the muscles of the middle and lower face, as well as the neck, become weaker or/and sarcopenic due to the shortening or collapse in the person's vertical dimension. Although influences of most of these factors are difficult to alleviate, nutritional habits and physical activity are within an individual's control and can help mitigate sarcopenia. While it is generally known that physical exercise is a productive and affordable means for alleviating disease and improving physical and mental health, it is largely unappreciated that face muscles can and should be exercised. Such exercise can provide numerous health benefits, for example, in the protection against sarcopenia.

According to the article entitled "Effect of a facial muscle exercise device on facial rejuvenation" (PMID: 29365050), published in 2018, the use of the Pao Jaw Muscle Trainer facial device proved to have "increase[d] facial muscle thickness and cross-sectional area, thus contributing to facial rejuvenation". Thus, there is some awareness regarding facial muscle training. However, this awareness is still not pervasive, and as soon as the awareness expands, the demand for more efficient, user-friendly devices and methods will grow as well.

Thus, there is an established need for a safe, efficient, convenient-to-use, and affordable facial muscle exercising device capable of mitigating sarcopenia. Such a device can substantially postpone face lifting surgery while also strengthening the fibers of facial muscles before such a surgery, as well as strengthening the facial and neck muscles of an edentulous person, aiding in oral rehabilitation and preventing the early signs of sarcopenia caused by natural dentition wear out. The device may further be used by patients temporarily left with sequels caused by a long period of muscular dysfunction, such as in Bell's paralysis, which helps to recover tonicity of the muscles affected by temporary muscular dysfunction. Still further, such a device can also be used in physiotherapy exercises for patients with paralysis and/or to reestablish better symmetry of the face when the soft tissue is sarcopenic. The present invention is provided to address these needs.

SUMMARY OF THE INVENTION

Contrary to the majority of body muscles that are attached to bones in their origin and insertion, and therefore easily exercisable, the majority of face muscles are attached to other muscles or soft tissue at their insertion as well as their origin in some cases, making them difficult to be controlled, stimulated and/or exercised. This particularly true for the majority of the muscles of the middle and lower face that are attached to the modiolus, e.g., the muscles attached at the corners of the mouth (see FIG. 1).

The modiolus is an anatomical region located laterally and slightly superior to each angle of the mouth where facial muscles of the middle and lower face converge at their insertions. The eight to nine muscles that meet at this insertion, forming the modiolus, include the orbicularis oris muscle, the depressor anguli oris (triangularis), the levator anguli oris (caninus), the quadratus labil superioris, the quadratus labil inferioris, the buccinators, the risorius, the zygomatic major, and the platysma muscle, as illustrated by FIG. 1. These muscles are predominantly responsible for controlling facial expression and are functionally related to certain neck muscles. The postural aspect of the muscles inserted at the modiolus, and the other muscles in this area, are directly linked to the bone that form the upper jaw, the mandible, teeth volume, and periodontal bone and tissue and are functionally related to the other muscles of the upper, middle & lower face as well the neck. Natural wear out of dentition contributes to the collapse of the jaw (i.e., shortening the person's vertical dimension), which negatively impacts these muscles, causing them to lose their natural tension. This causes premature aging of the face unless the atrophy process is challenged. Thus, an exercise device that is capable of stretching those muscles beyond their normal capacity is a goal of the present invention by stimulating these muscles to contract more intensely, which aids in the prevention of the loss of tension.

Various illustrative embodiments of the present disclosure provide a device for exercising face and neck muscles. In accordance with one aspect of an illustrative embodiment of the present disclosure, the device is a safe, efficient, user-friendly, affordable device configured to exercise/stimulate the muscles that converge at the modiolus areas of the face as well as muscles adjacent thereto.

According to a first aspect of the invention, the device is designed based upon the muscular architecture of a human face, as described above, and is configured to stimulate or otherwise exercise the muscles located in the modiolus areas. The device includes a pair of bars, a pair of modiolus holders, and a pair of handles. The pair of bars are configured to be separate from one another, for example via a rotatable connection. The modiolus holders are attached to proximal ends of the bars and the handles are attached to distal ends of the bars. The handles and the modiolus holders are symmetrical to each other relative to the central line of symmetry of the device.

According to the first aspect, the device is configured to stimulate the muscles inserted at the modiolus area by the application of mechanical forces. The applied forces contribute to stretching of the muscles, stimulating them to contract beyond their normal capacity. The device is configured to keep the magnitude of muscle displacement within anatomical limits so as to provide a user-safe device. According to one example, the device allows the user to apply an external force to both modiolus areas where the facial muscles converge, as well as to adjacent facial muscles and to the muscles of a face and neck that are functionally engaged with the modiolus areas.

According to a second aspect of the invention, methods of using the device include placing the modiolus holders at locations within the mouth such that the modiolus holders contact and are secured to the modiolus areas of the face from within the mouth. The handles are then moved away from each other, which increases the distance between the modiolus holders. This movement stretches the muscles of the lips and secures the muscles that converge to form the modiolus. With these muscles secured, the device can be angled and pulled away from the face, generating a force, by the device, to stretch these muscles beyond their regular capacity. The user then resists the additional force, thereby stimulating these muscles to contract beyond their regular capacity. In this way, the device allows for a method of resistance training of these muscles, which provides more intense training than can be accomplished through general muscle flexion. Thus, the muscles attached to the modiolus, as well as muscles connected thereto are exercised. Because these target muscles are located in areas that typically cannot be stimulated or exercised, due to their attachment to soft tissue and close proximity to the oral cavity, devices according to the present invention advantageously provide efficient, targeted stimulation and exercise of facial and neck muscles by stretching, allowing these muscles to contract beyond their natural ranges. The invention is not limited to the above-described methods, and may variations thereof are within the scope of the present invention.

According to embodiments of the invention, the device may be a completely manually operated device, may be a semi-manual operated device, or may be a combination thereof. According to an illustrative embodiment of a completely manually operated device, a user or an operator applies manual force to the handles of the device, which separates the modiolus holders and stretches the muscles connected to modiolus. The operator/user then angles the device and moves it away from their face, thus translating into mechanical stimulation of the targeted muscles. The user can further activate the muscles of their face to counteract the force applied by this movement, thereby providing resistance training of the muscles.

According to an alternative embodiment implementing semi-manual operation, weights, springs, resistance bands, or the like may be attached to a distal end of the device to aid in providing the force to move the device away from the face. An indicator can also be located at the handles to indicate the degree of separation. According to certain of these embodiments, the device is incorporated into an exercise system configured to mimic the necessary steps for exercise and stimulation of the muscles of the face and neck.

According to a further embodiment, a spring may also be placed inside the handle of the device and configured to indicate the amount of force the muscles are providing during the resistance training.

According to another aspect of the invention, the device has a neutral position that may be set by a stop system. In the neutral position the device stretches the user's modioluses apart up to maximum comfortable and safe amplitude, thereby helping to secure the muscles of modiolus areas on the device. Once in this position, force is applied to the device to move it away from the face, such that the user's muscles resist the force, thereby providing resistance training. The stop system may further include a spring to aid in maintaining the neutral position and to provide a degree of flexibility once the modioluses have been stretched and secured.

The described modes above, or combination thereof, advantageously achieve a higher capacity to contract the muscles of the face and neck and provide external forces with different, case specific, profiles. This results in the delay and partially mitigate of face and neck muscle sarcopenia, augmentation of the volume of muscle fibers, enhanced facial and neck muscle fitness, strengthened temporomandibular ligaments (TMJ), improved skin health, increased blood circulation in facial and neck tissue, reduced wrinkles, increased production of endorphins, enhanced self-esteem, and healthier bone tissue.

DETAILED DESCRIPTION OF THE EMBODIMENTS

Detailed embodiments of facial and neck exercising and stimulating device are disclosed herein; however, it is to be understood that the disclosed embodiments are merely illustrative of the facial and neck exercising and stimulating device that may be embodied in various forms. In addition, each of the examples given in connection with the various embodiments of the facial and neck exercising and stimulating device are intended to be illustrative, and not restrictive. Further, the drawings and photographs are not necessarily to scale, and some features may be exaggerated to show details of particular components. In addition, any measurements, specifications and the like shown in the figures are intended to be illustrative, and not restrictive. Therefore, specific structural and functional details disclosed herein are not to be interpreted as limiting, but merely as a representative basis for teaching one skilled in the art to variously employ the Device.

Figure 1:
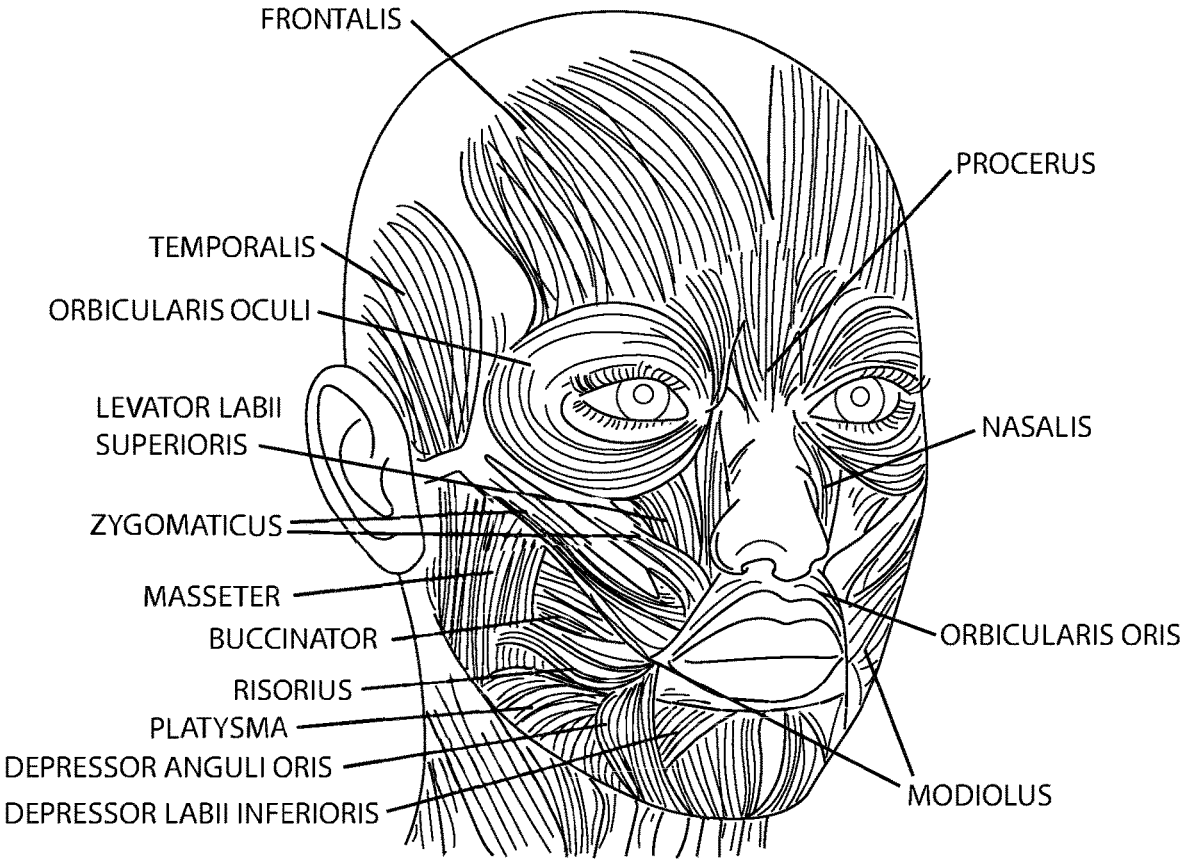
FIG. 1 is a respective view of a human face illustrating facial musculature and the location of facial modioluses.
Figure 2:
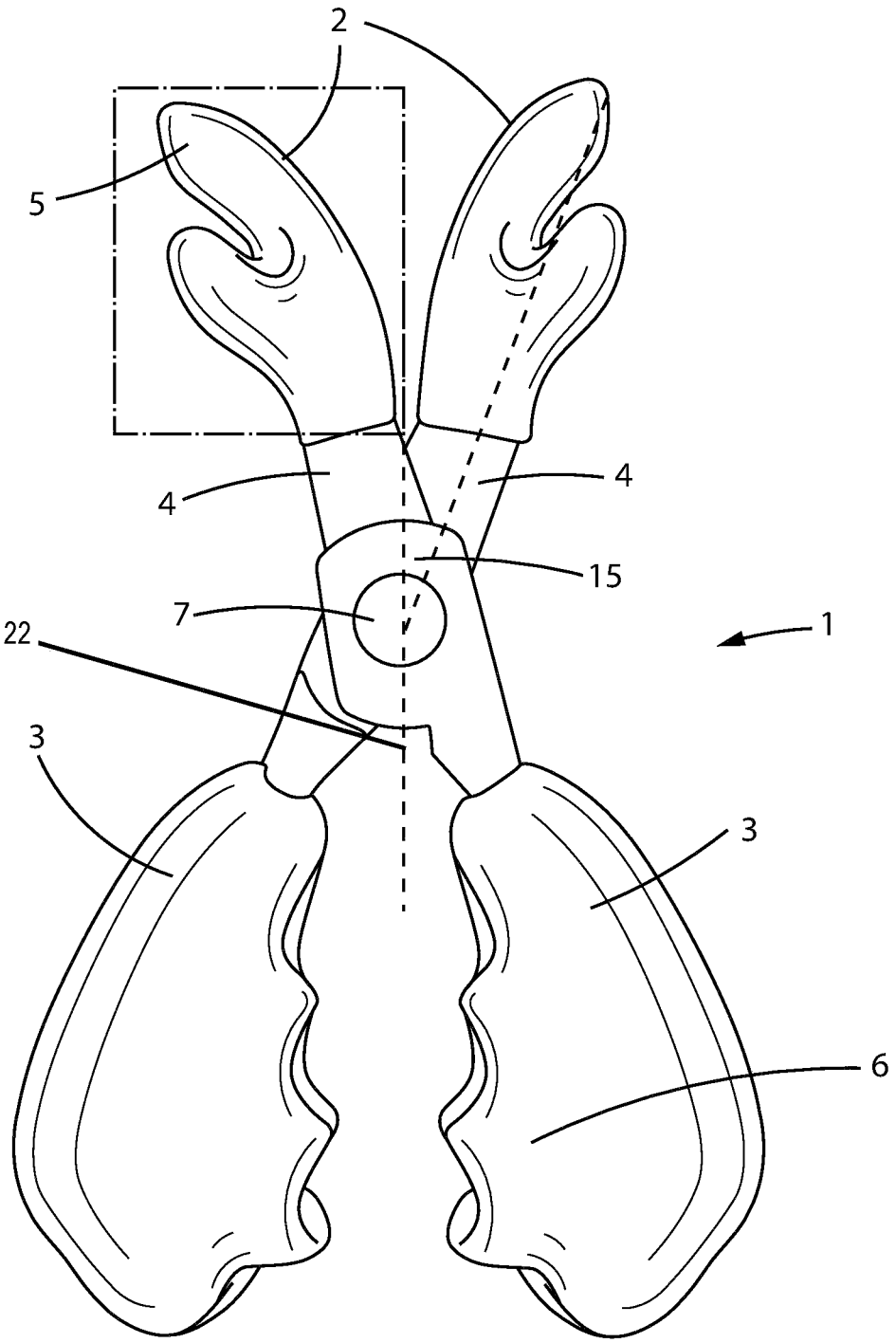
FIG. 2 is a front view of a device according to embodiments of the present invention.
Figure 3:
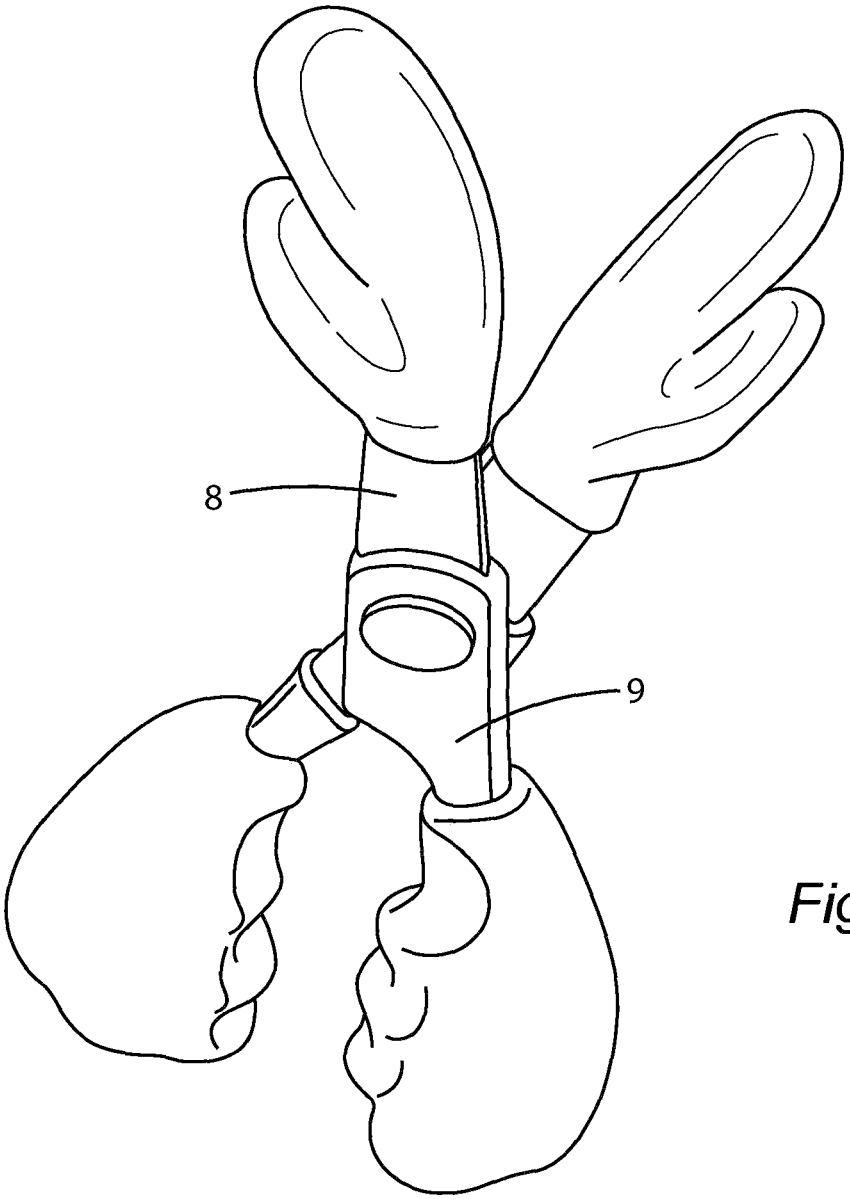
FIG. 3 is a back view of a device according to embodiments of the present invention.
Figure 4:
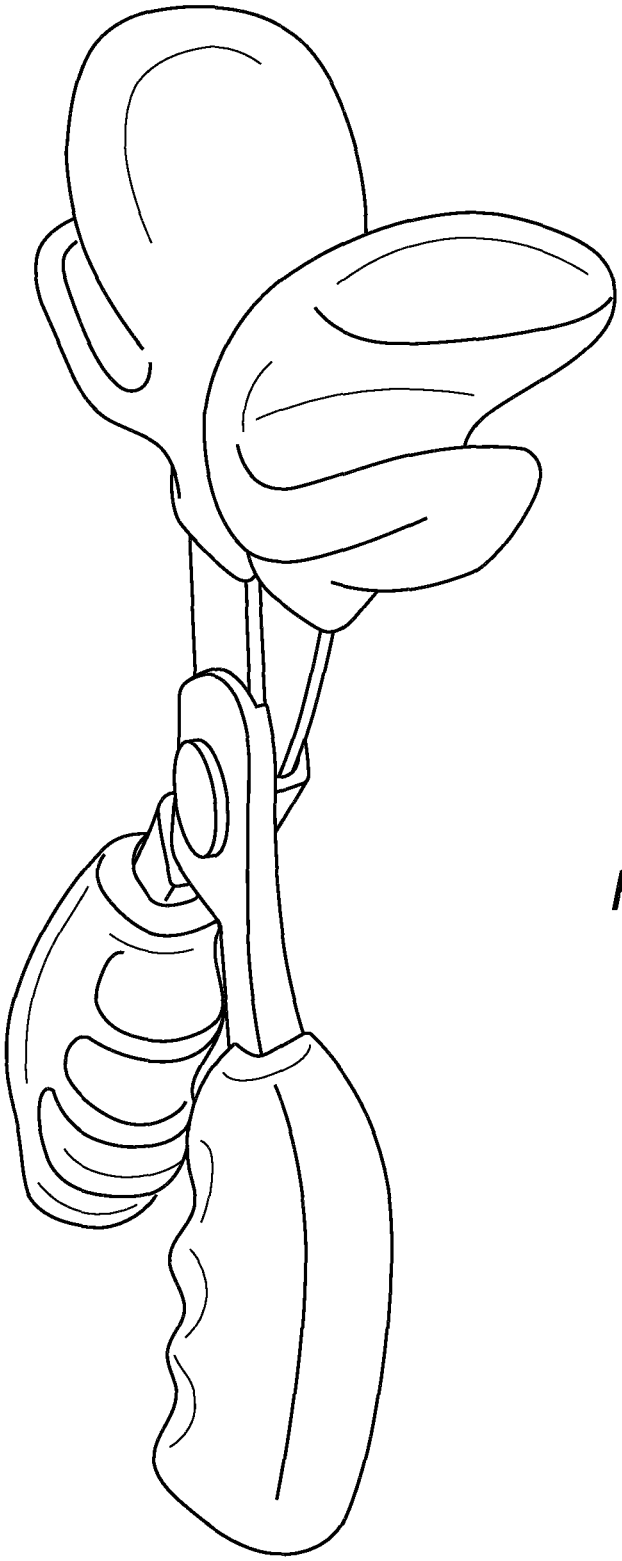
FIG. 4 is a perspective view of a device according to embodiments of the present invention.

With reference to FIGS. 2-4, an embodiment of a facial and neck exercising and stimulating device is illustrated. The device 1 includes a pair of modiolus holders 2, a pair of handles 3, and two bars 4. According to embodiments, the handles 3 of device 1 are shaped so as to provide easy gripping by a user's hands. Bars 4 may be permanently or releasably connected to each other in a rotatable fashion via rotatable connection 7. The connection of the bars 4 may generally form an X shape, as illustrated by FIGS. 2-4. However, the bars 4 may form other shapes, such as parallel lines (see FIG. 9B), an H shape, or a W shape, so long as the shape they form allows for the separation of the modiolus holders. The bars 4 of device 1 may be symmetrical to each other relative to the longitudinal axis of the device 1. The handles 3 and the modiolus holders 2 may similarly be symmetrical to each other relative to the longitudinal axis of the device 1. As further illustrated by FIGS. 2-4, each of the bars 4 has a proximal and distal end. The proximal end of each bar 4 is connected to or otherwise secured with a modiolus holder 2, and the distal end of each bar 4 is connected to or otherwise secured with a handle 3.

With reference to FIG. 3, the portion of each bar 4 positioned between the proximal end and rotatable connection 7 is referred to as the upper arm 8. Each upper arm 8 has an upper arm length L1. The portion of each bar 4 positioned between the distal end and the rotatable connection 7 is referred to as the lower arm 9. Each lower arm 9 has a length L2. The net force (e.g., pulling or pushing force) F2 exerted on lower arms 9 (e.g., by pulling handles 3 apart) produces a net force F1 at modiolus holders 2. The aforementioned lengths and forces are related to each other in accordance with the following formula: L1/L2=F2/F1. Accordingly, by varying lengths L1 and L2, the L1/L2 ratio can be modified which allows for a variation in proportionally of forces F2 and F1. Thus, by modifying the lengths the device is configured to provide varying levels of force to the modiolus holders 2.

According to an illustrative embodiment of the invention, modiolus holders 2 are shaped and configured to secure and engage with the modiolus areas of the face of the user in a safe manner. According to one embodiment, the modiolus holders 2 have an anatomical shape with an exterior surface resembling a mitten (See, e.g., FIG. 5). Such a shape evenly distributes the force applied to the modiolus areas while also minimizing the risk of the adjacent soft tissues impingement, mitigating the risk of irritation of the engaged skin, and preventing damage to the oral mucosa.

Figure 5:
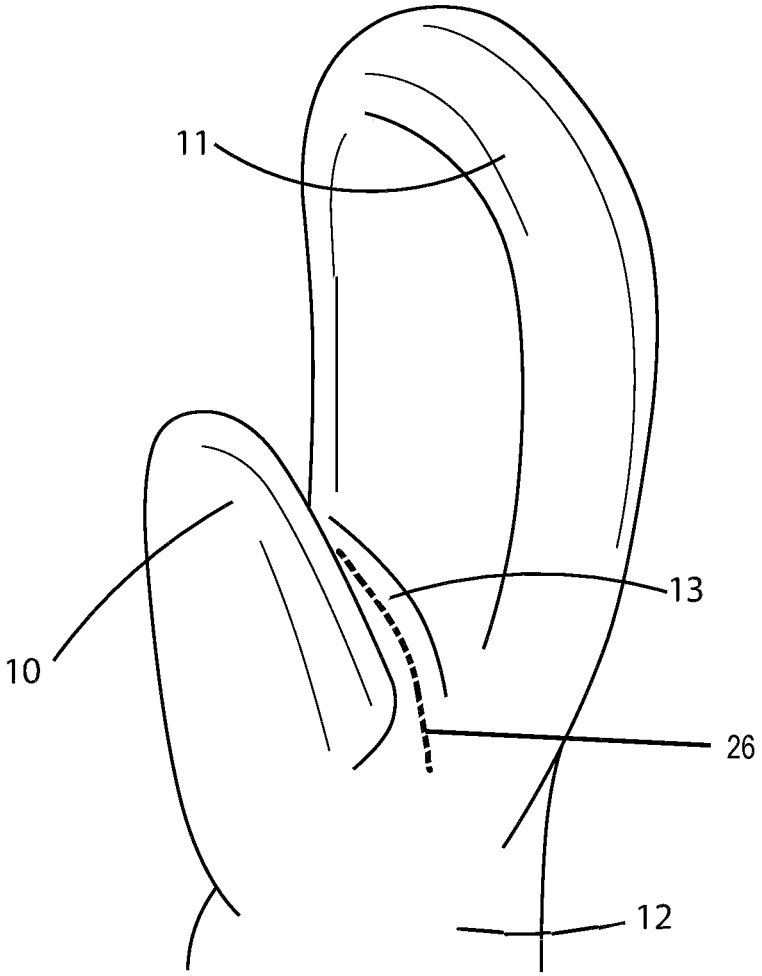
FIG. 5 is a side view of a modiolus holder of a device according to embodiments of the present invention.

With reference to FIG. 5, the portion of the modiolus holders 2, when in use, that are positioned outside of the user's mouth and in close contact with the skin are referred to as the thumb 10. The portion of the modiolus holders 2 placed inside of the user's mouth and in contact with the oral mucosa of the mouth are referred to as the hand 11. The thumb 10 and hand 11 connect to one another at the location of base 12. An inferior space, in the form of an anterior-posterior groove 13, is created between the hand 11 and the thumb 10, which accommodates the corner of a mouth. Groove 13 is usually deeper and projects more downwardly in the posterior direction. An angle formed between the center line of the device 22 (as shown in FIG. 2) and the center 26 of groove 14 is between approximately 100 and 45°.

Both the thumb 10 and the hand 11 extend from the front to the back side of the device 1 forming a shell-like shape, and the exact dimension of the thumb 10 and the hand 11 may be sized according to the individual user's mouth. According to an alternative embodiment, the dimensions of the modiolus holder 2, and thus the thumb 10 and hand 11, may be standardized (e.g., according to average anatomical dimensions) and come in a variety of sizes. According to a preferred embodiment, the hand 11 is longer and has a larger surface area than the thumb 10.

Figure 6:
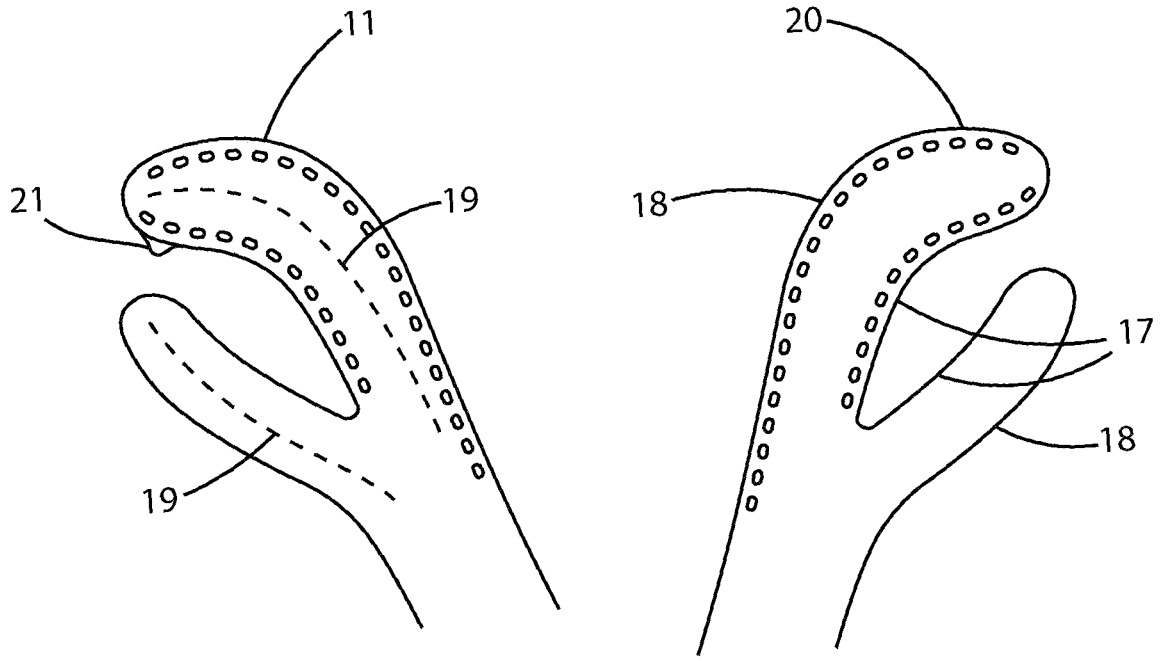
FIG. 6 is a front view of a modiolus holders of a device according to embodiments of the present invention.

With reference to FIG. 6, the hand 11 and the thumb 10 are each provided with a plurality of surfaces. The surface of the thumb 10 that engages with the skin and the surface of the hand that engages with oral mucosa (i.e., the inside of the mouth) are referred to as the inward surfaces 17. The surfaces of the thumb 10 and the hand 11 that oppose the inward surfaces 17 are referred to as the outer surfaces 18. The thumb 10 and hand 11 each further include curved side surfaces 19 that connect the inward surfaces 17 with the outer surfaces 18. A part of the outer surface that is farthest from the geometrical center of the rotatable connection 7 of the bars 4 is referred to as the top surface 20.

The outer surfaces of the hand 11 and the thumb 10 are convexly shaped, and the inward surfaces of the hand 11 and the thumb 10 are concavely shaped, which generally attenuates at top surface 20. The concavity of the inward surface of the hand 11 is greater that that of the inward surface of the thumb 10 so as to provide a better anatomical engagement between the modiolus holders 2 and a modiolus areas of the face. A protuberance 21, which may vary in size, may be placed on the inward surface 17 on the hand 11 for better retention of a modiolus.

According to the preferred embodiment, the surface of the modiolus holders 2 is covered with or made from a biocompatible material. Such biocompatible materials include, for example, high molecular polyethylene, biocompatible polished ceramics, pure titanium or biocompatible titanium alloys. Alternatively, the modiolus holder can be made of a non-biocompatible material or partially biocompatible material and covered with a disposable cap or film made of a biocompatible material. For example, if the device is to be used by a single individual, there is no concern for cross contamination between users, and thus, the need for a disposable cap or film is unnecessary. However, when the device is to be used by multiple users, the disposable cap or film provides a means to prevent any cross contamination between users. Additionally, the surface of the modiolus holders 2 or parts thereof may be covered or otherwise coated with an antimicrobial material/layer in order to prevent skin or mucosal bacteria from growing.

Figure 7:
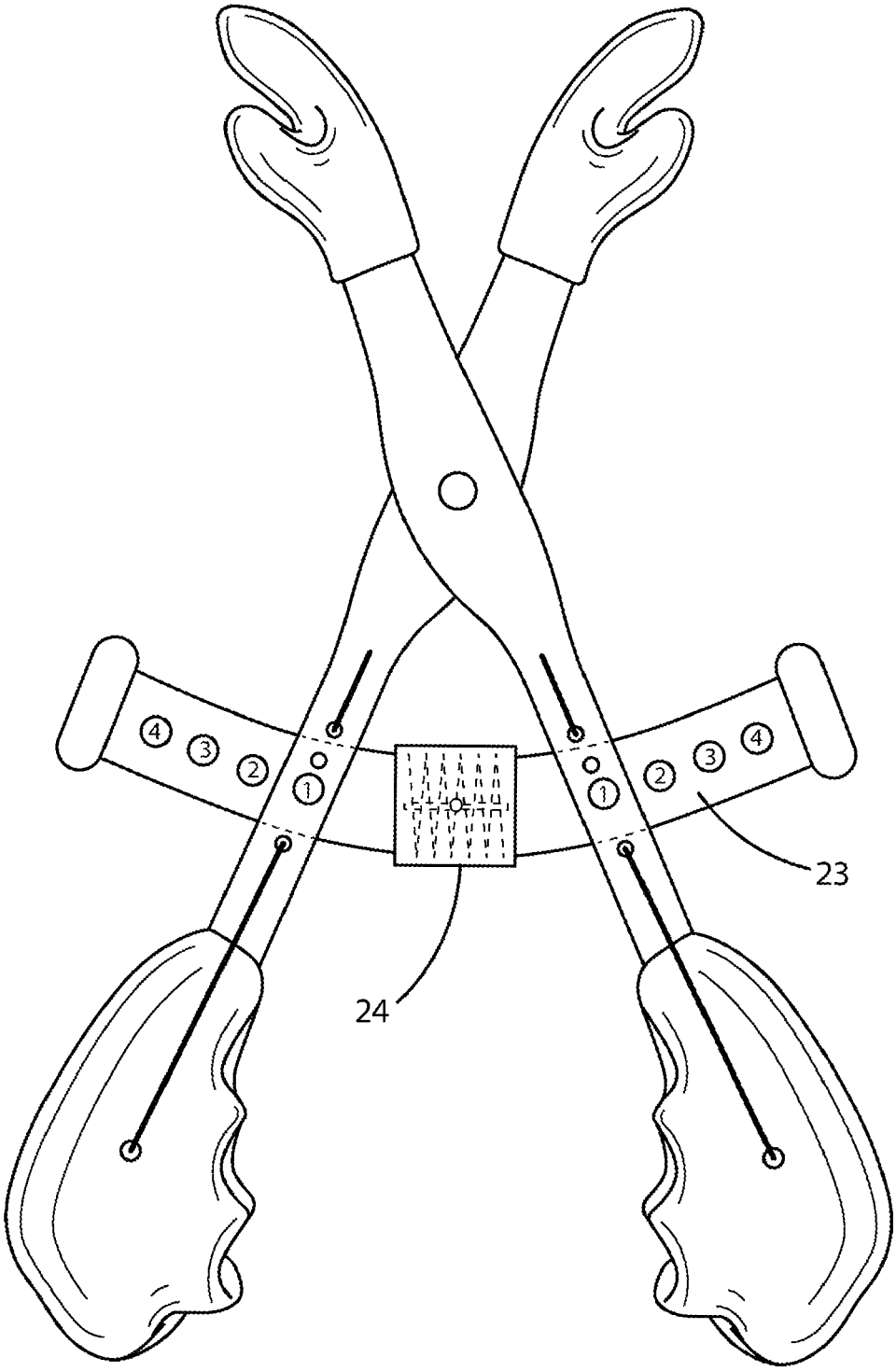
FIG. 7 is a front view of a device according to embodiments of the present invention with a stop and spring system.

According to a further embodiment of the invention, and with reference to FIG. 7, the device may include a user configurable stop system 23, which allows a user to select a maximum allowed separation of handles 2, and thus separation of modiolus holders 2. The device can further include a spring system 24 configured to help maintain this separation and provide a degree of flexibility for handles 2 move relative to one another, allowing for a more physiological and organic functioning of the device. Although spring system 24 is illustrated as including a spring for, the spring system may employ alternative elements (e.g., a pair of opposing polarity magnets). It should be noted that stop system 23 may not limit a user's capacity to manually adjust the force applied by the device to the modiolus area of the face.

According to certain embodiments of the invention, the device 1 may further include a force gauge (not shown) that measures the force applied by the device 1. Such measurements may be monitored in real time in order track use of the device 1 and to better aid in long term exercise regimes. Additionally, the force gauge may be configured to transmit, either wirelessly or via a wire, to a remote device, such as a user's smartphone, laptop, or smartwatch in real time.

Figure 8:
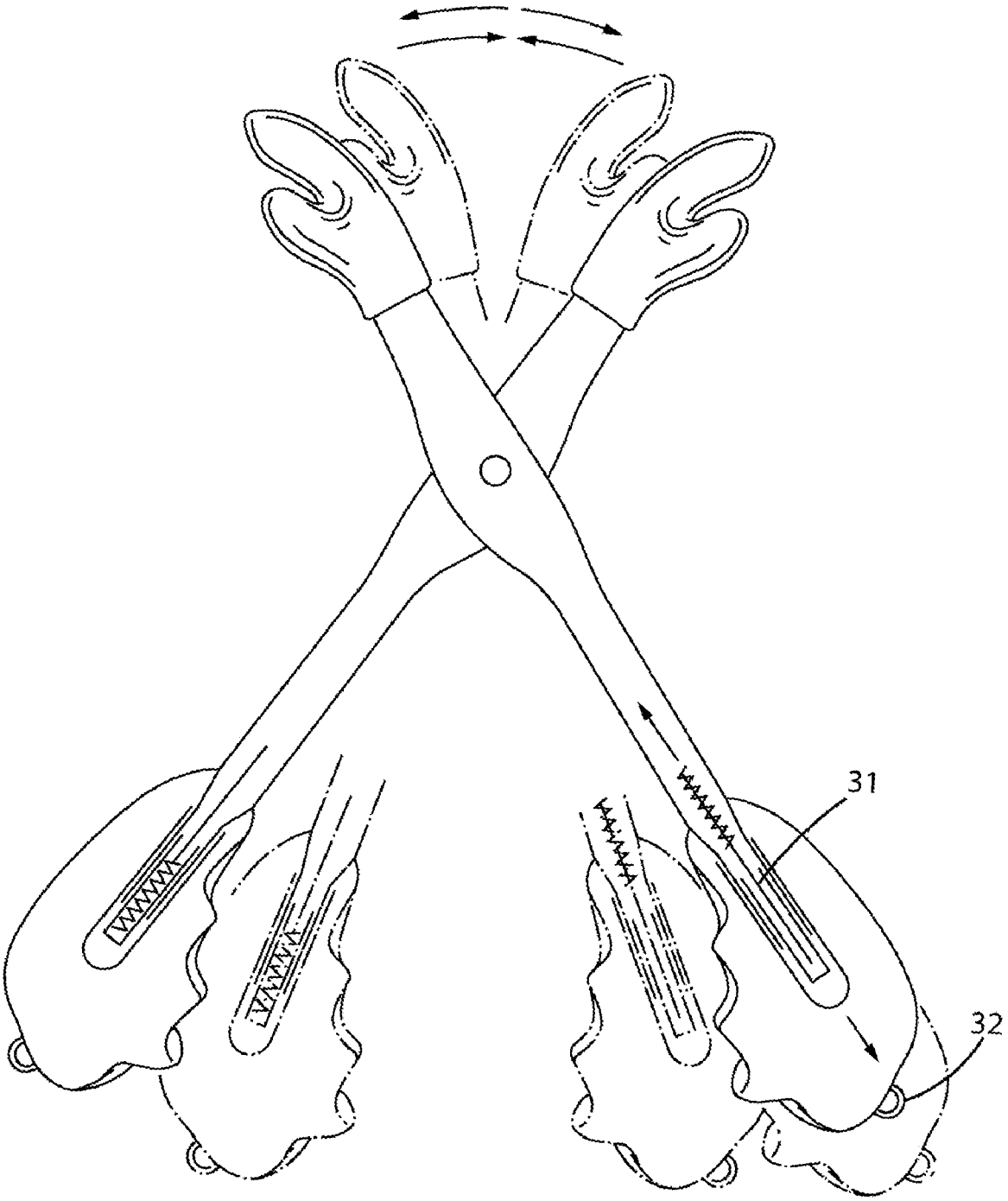
FIG. 8 is a front view of a device according to embodiments of the present invention with a slide mechanism.

According to a further embodiment of the invention, and with reference to FIG. 8, the device may include a slide mechanism 31 that extends and retracts, reflecting the contractions that the muscles are exerting. The device can further include a fixation element 32 to which weights, bands, tubes, etc. may be attached to aid in providing the necessary pulling force.

Methods of using the device 1 include placing the modiolus holders 2 at locations on the face and within the mouth such that the hand 11 and thumb 10 of the modiolus holders 2 contact and grasp the modiolus areas of the face. The handles 3 are then moved away from each other such that the angle at rotatable connection 7 between bars 4 is increased, which increases the distance between the modiolus holders 2. With these muscles secured, the device 1 can be angled upwardly or downwardly to target muscles of the upper, central or lower face, and pulled away from the face, generating a force, by the device, to stretch these muscles beyond their regular capacity. The user then resists the pulling force by contracting their facial and neck muscles, thereby stimulating these muscles to contract beyond their regular capacity. By repeating these steps the user is able to exercise the muscles of the face and neck, thereby strengthening them and counteracting sarcopenia.

Figure 9A:
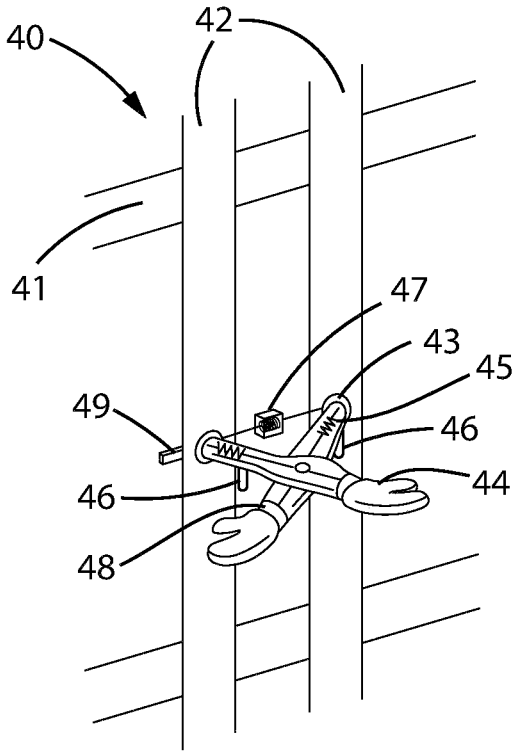
FIGS. 9A to 9D show exercising systems implementing a device according to embodiments of the present invention.

According to further embodiments, as illustrated by FIG. 9A, the device may be a part of an exercising system 40. The system includes horizontal bars 41 and vertical bars 42 that are slideable relative to one another. The device is configured to be attached to the vertical bars 41, as illustrated by FIG. 9A, via attachment means 43, such as a ball joint socket. A vertical stop 49 in conjunction with slide adaptor 50 can be employed to adjust and lock the height of the device. As described in greater detail above with reference to FIGS. 2-6, the device includes a pair of modiolus holders 44, and two bars, each having a distal mechanism 45. The bars may include hand rests 46. A stop system 47 is attached to the device, and act as a stop as described above with regard to FIG. 7. Additionally, in order for multiple users to utilize exercising system 40, modiolus holders 44 may be detachable, and attach to the device via attachment means 48. According to an alternative embodiment, as illustrated by FIG. 9B, exercising system 40' includes a device having two parallel bars (as opposed to an X shape as depicted in FIG. 9A).

Figure 9B:
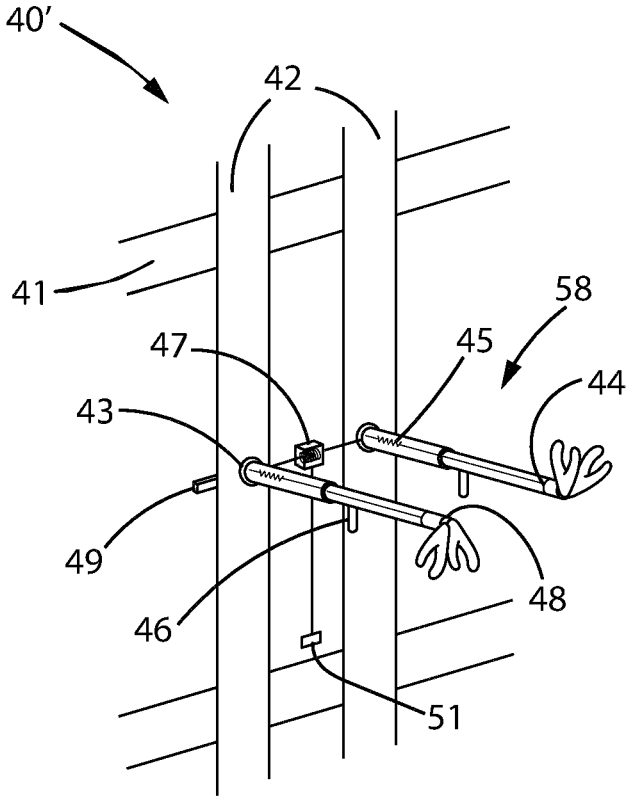
Figure 9C:
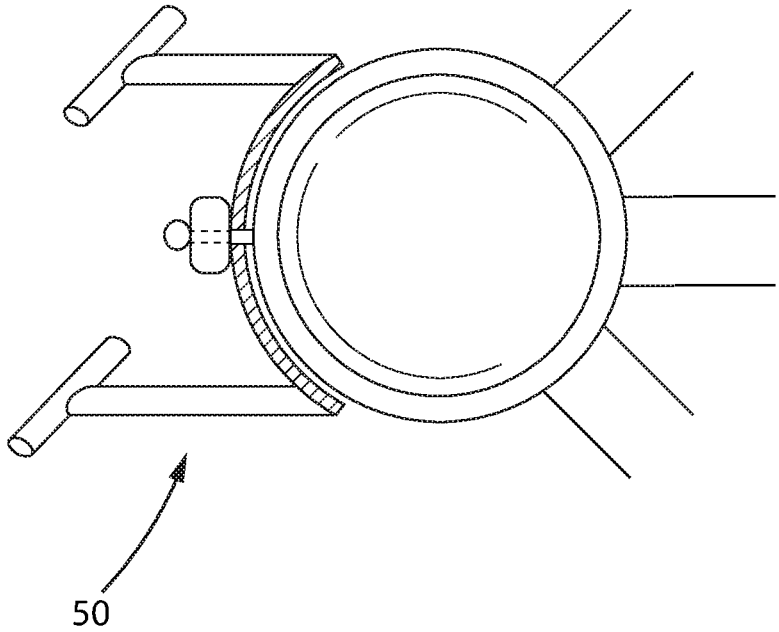

In order to operate the exercising system 40, 40', and as illustrated in FIGS. 9A and 9B, the user will adjust the height of the device by placing the modiolus holders 44 at a height corresponding to the corners of the mouth by adjusting the height of the device via sliding the device along the vertical bars 42 utilizing a sliding adaptor 50 and locking it at the chosen height using vertical stop 49. Then the modiolus holders 44 are introduced at the user's mouth, and stop system 47 will guide the bars of the device, moving them horizontally so as to separate the modiolus holders 44 and lock them into an ideal position to secure the modiolus areas of the face within respective modiolus holders 44. While all this action is taking place, the device is in a neutral position in regard to the forces necessary for the exercise to take place.

Figure 9D:
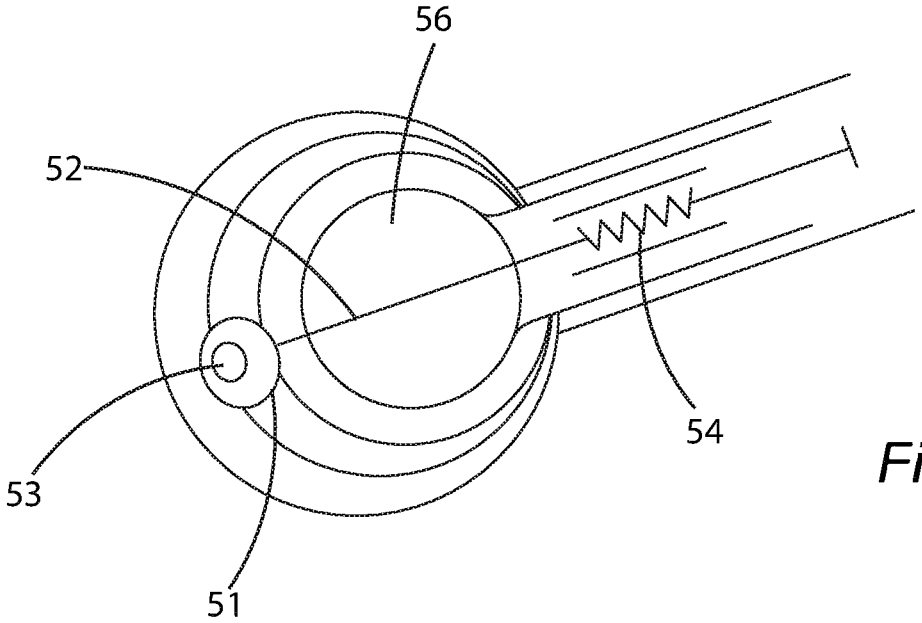

Once the modiolus holders 44 are secured, the device is then angulated. For example, the device can be angled up or down via attachment means 43 and the angle can be locked in and stabilized via stop mechanism 53 to keep the proper angle for a chosen exercise, as illustrated in FIG. 9D. According to one preferred embodiment, joint head 56 can angulate about the socket until a preferred angle is achieved, and stop mechanism 53 is used to lock in the angle.

Once the angled is locked in, pulling forces are then applied to the device by the use of, for example, cables and weights 51, 52, 54, or the like. The application of the pulling forces may be done by incremental augmentation until the proper tension is set and locked by the amount of weight used, or by other means of maintaining the proper tension of the device. After the pulling force is set, the user may start to contract the muscles that have been activated by the device, thereby exercising their face and neck muscles.

As discussed above, in order to provide the necessary pulling force to aid in the exercise their face and neck muscles, a weight 51 is attached to the device, via, for example, a cable 52 that runs through distal mechanism 45. A stop mechanism 53 can be implemented, in conjunction with a distal arm spring 54, to provide a means to monitor the applied force and to prevent excessive force from being applied.

The exercise system 40 may further include a safety mechanism (not shown) to immediately deactivated the system in case the user is not properly positioned to use the device.

Figure 10:
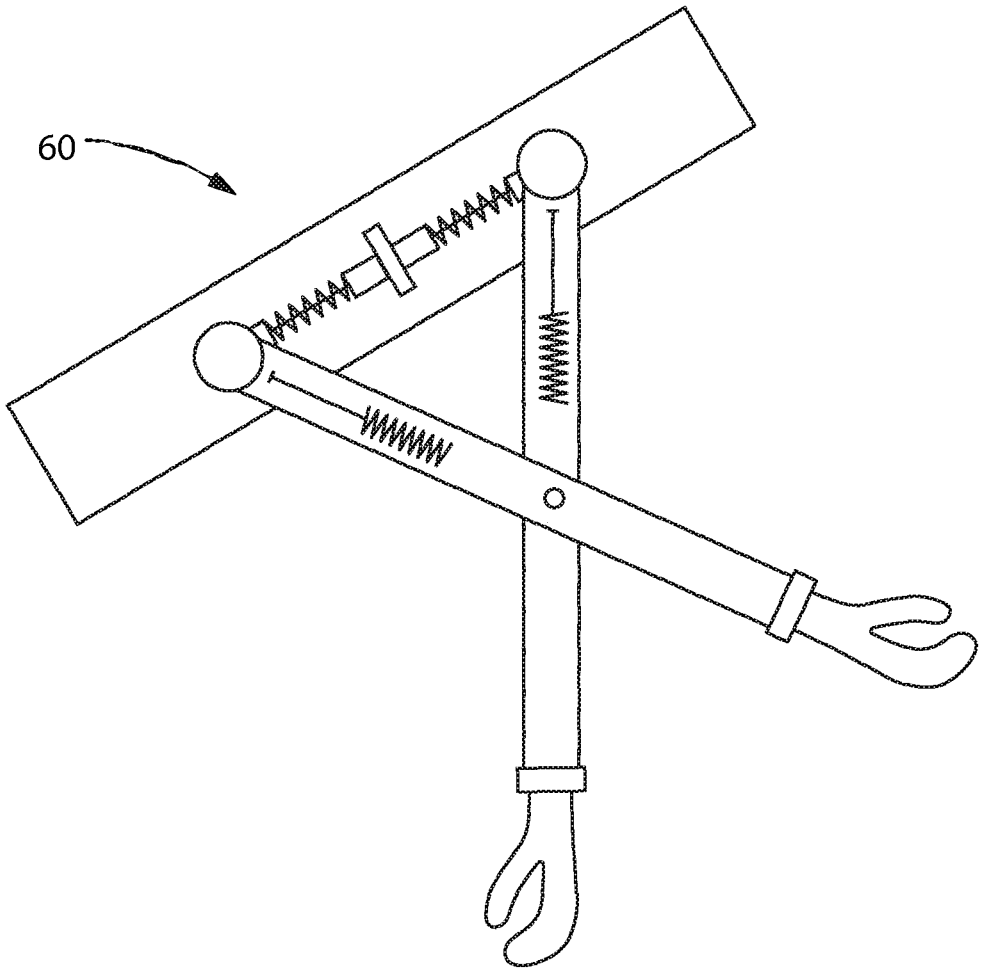
FIG. 10 is a front view of a device according to alternative embodiments of the present invention.

According to alternative embodiments, an exercise system 60 may be mounted on a single horizontal bar, as illustrated by FIG. 10. According to these embodiments, the use of an adjustable chair or other vertical orienting means will be implemented. For example, instead of vertically orienting the device in relation to the user, the chair can be used to set the proper height for the use of the device. The distance of the chair to the equipment may also be adjusted and security strips may be also added to the chair.

As further illustrated by FIG. 10, exercise system 60 may be a fully encased system, where only the bars and modiolus holders are exposed. For example, stop system 47, attachment means 43, may be placed within a secured housing such that they are not exposed to the user. According to a variation thereof, the housing may encase a substantial portion of the bars, having slots at its front end such that the bars can move away from one another. In such embodiments, controls may be conveniently located next to the user's hands.

According to certain variations of the embodiments discussed above, the modiolus holders may be configured to angulate about the bars, via attachment means 58. This will facilitate adjustment of modiolus holders, allowing the user to better customize the device to their anatomy so that the modiolus areas are better secured by the device. Additionally, pieces of the device may be modular. For example, the bars, modiolus holders, and handles may be modular components configured to attach to one other to form the device. Such a configuration allows for the device to be broken down and easily carried.

Figure 11:
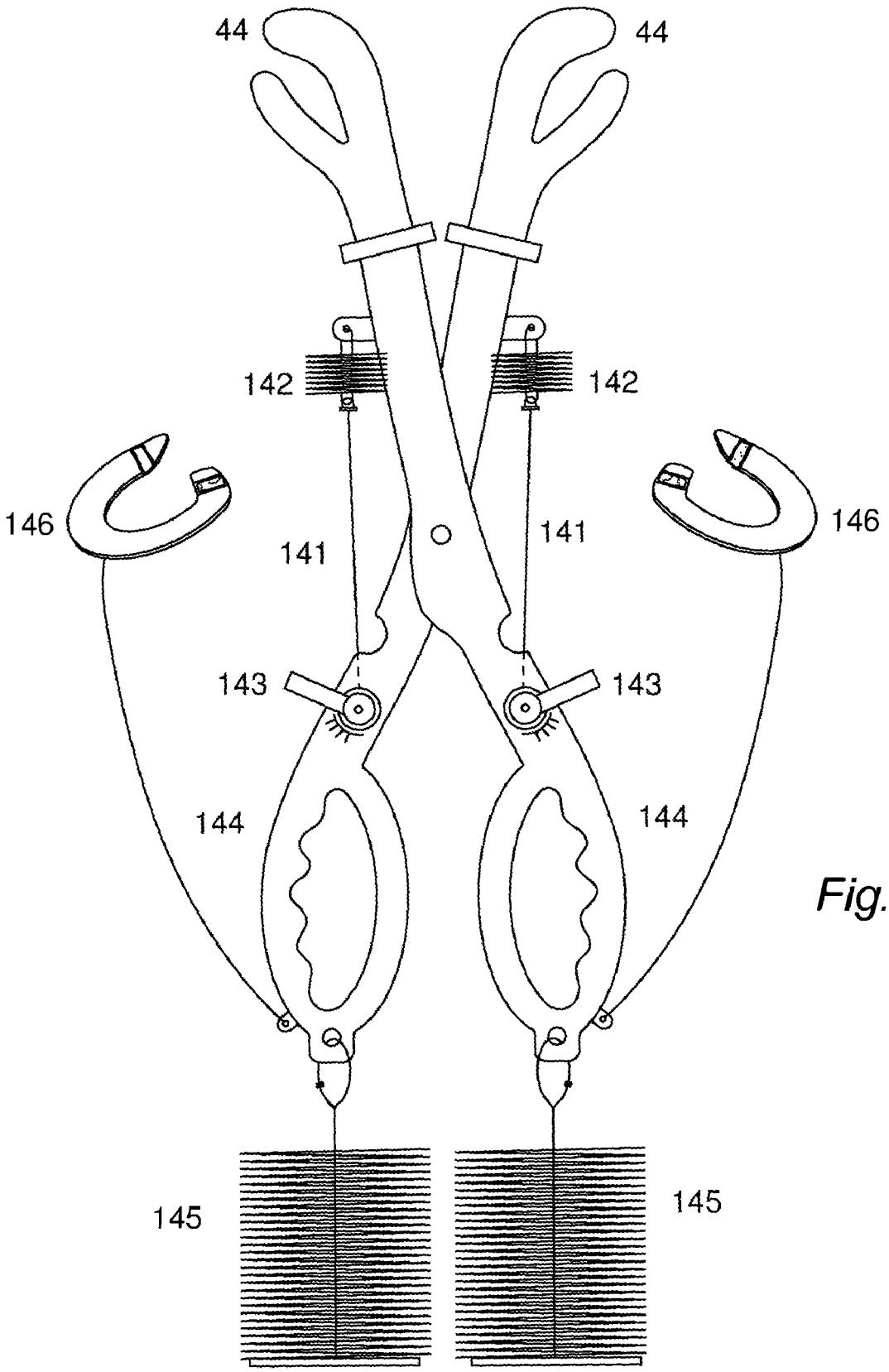
FIG. 11 is a front view of a device according to alternative embodiments of the present invention.

With reference to FIG. 11, an alternative to spreading the crossed bars as well as securing the pair of modiolus holders 44 is illustrated. According to an embodiment, by using cables 141, springs 142, and a tension control knob 143, a user is able to calibrate a desired tension for an exercise. The springs 142 can be replaced with stronger ones as the user progresses with the exercises. The figure also depicts modified handles 144, in which each of the handles 144 includes a respective hand-sized hole. The figure also depicts respective sets of stacked weights 145, which can be hung on each holder 44 for extra resistance. The weights 145 can be replaced with heavier ones if desired. Further, the device can also include a pair of wrist straps 146 for safety, which can be attached, e.g., via an eyelet, to the handles 144.

Figure 12:
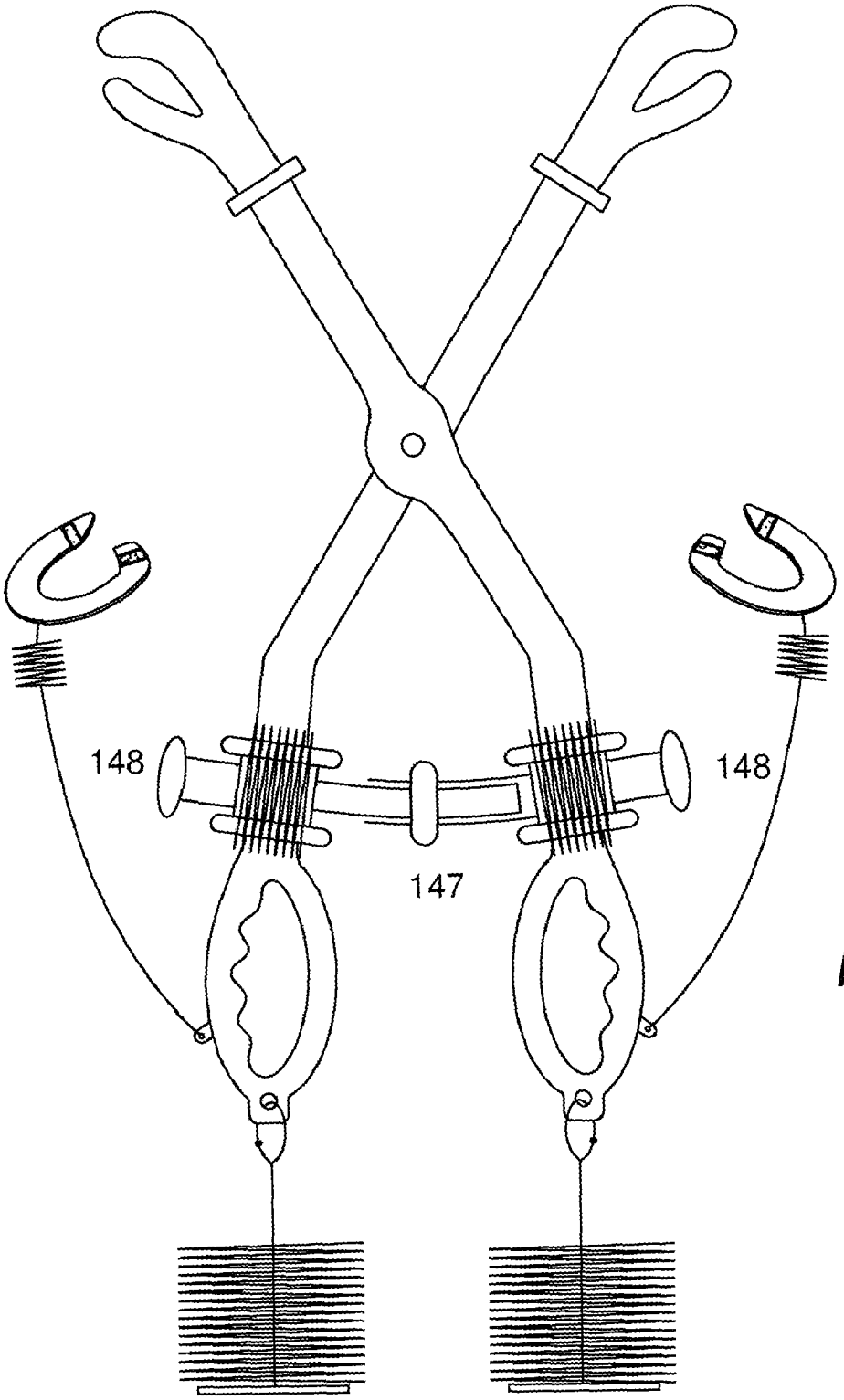
FIG. 12 is a front view of a device according to alternative embodiments of the present invention.

FIG. 12 illustrates the device of FIG. 11 with a curved expansion bar formed by two sliding half bars as well as a centered locking mechanism 147, which can be used to set the proper opening of the device as desired by the user. The device can also include a bilateral-located resistance mechanism 148 at each end of the curved expansion bar that, when rotated, controls the amount of resistance desired by the user.

Figure 13:
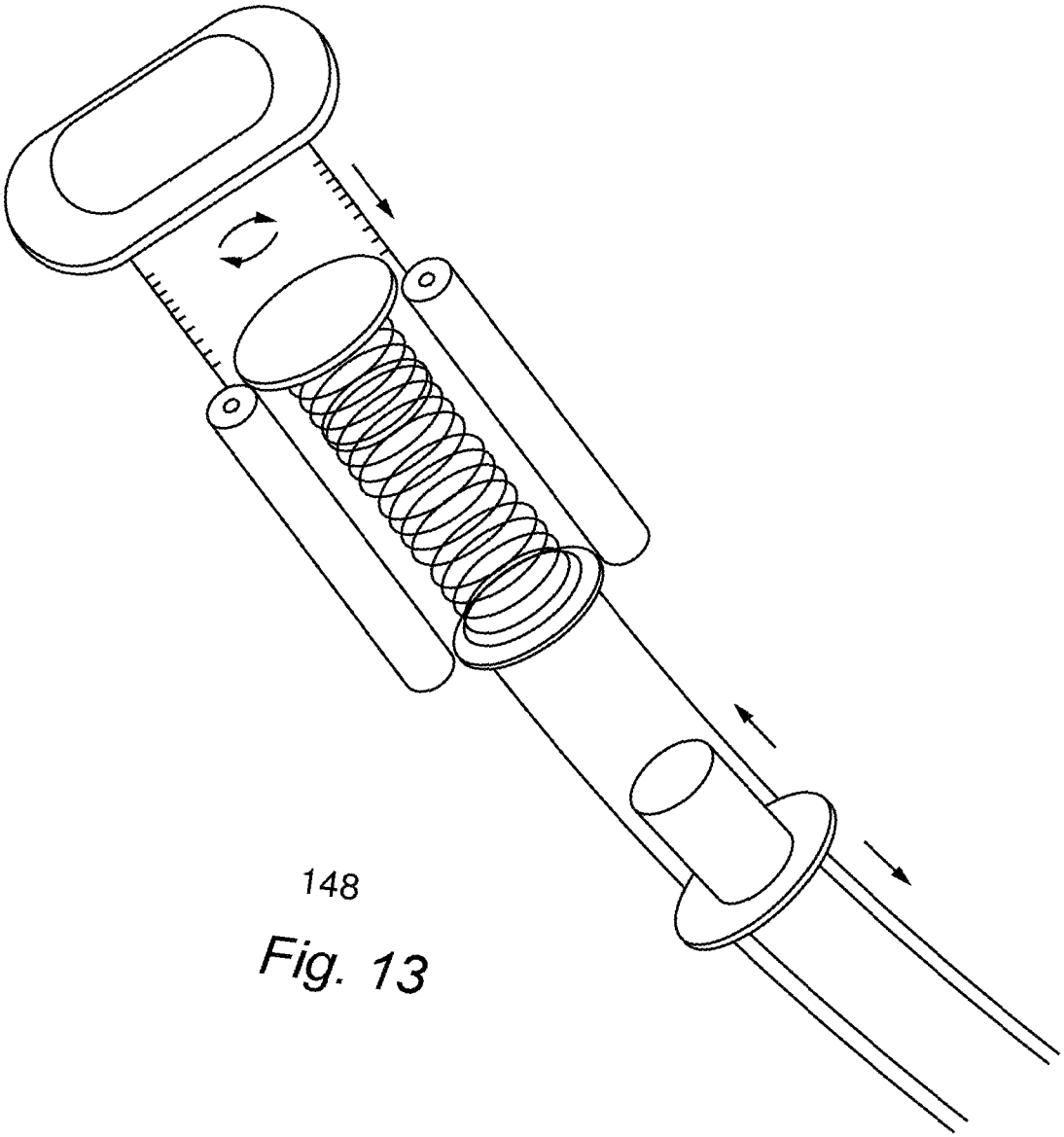
FIG. 13 is a perspective view of a resistance mechanism for a device according to embodiments of the present invention.

FIG. 13 illustrates the resistance mechanism 148 in more detail. According to an embodiment, marks on a turning knob can guide the user to augment the resistance as desired. Further, the resistance mechanism can be replaced if/when the forces placed by the user's muscles increase with the device's use.

Figure 14:
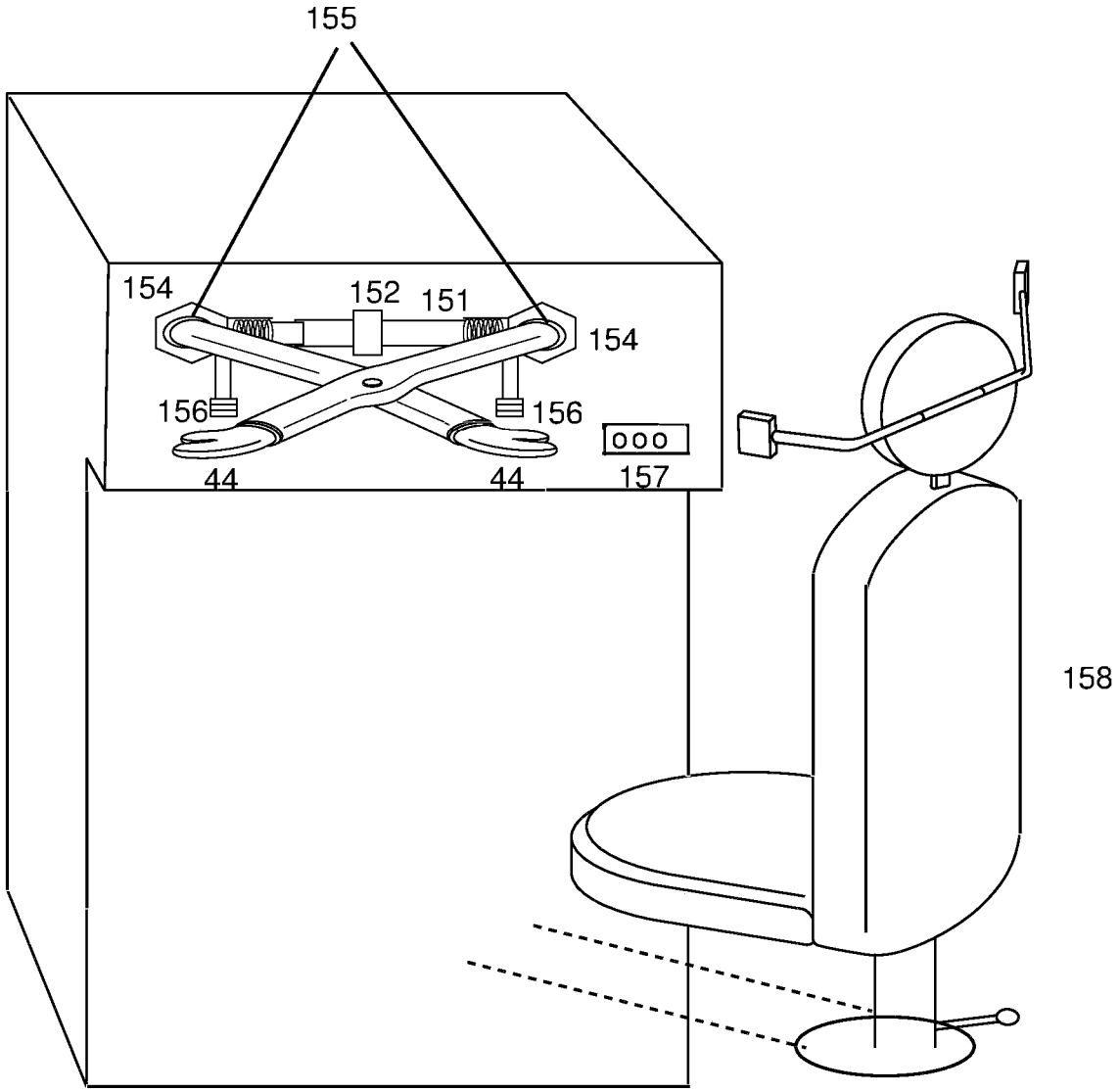
FIG. 14 is a front view of an exercise system implementing a device according to alternative embodiments of the present invention.

FIG. 14 illustrates an alternative embodiment of the exercising system 40. As depicted in the figure, for exercise system 150, the exemplary device can be mounted on a horizontal bar 151, which sits on a vertical stand/support that can house other components used for the function of the device. According to an embodiment, the horizontal bar 151 can include an expansion system of the device, which allows the user to set the distance necessary to maintain the pair of modiolus holders 44 engaged at the corners of the mouth. The system 150 can also include a locking mechanism 152 to secure the pair of modiolus holders 44 to the corners of the mouth by sliding two overlapping half bars that are pressured on their distal end against a spring mechanism attached to a junction box 154. The system 150 can also include condylar junctions 155, which can be connected to each distal end of the device. In particular, the condylar junctions 155 are located on the entrance of each junction box 154, at each end of the expansion mechanism. These joints can be seen in greater detail in FIG. 15. Further, the joints can be CV joints or any other type of joint that may be either connected to a cable or some other type of mechanism (so long as it allows for the joint's movement and the application of measurable resistance). The system 150 can also include device handles 156, which allow the user to hold the device, e.g., for support and movement guidance. Further, the system can also include a control panel 157 (electronic and/or mechanical) which allows the user to adjust the expansion of the device (e.g., to have the modiolus holders 44 adjusted to the modiolus area), to control the resistance necessary for each user, and to also control the angles necessary for the performance of the exercise. According to an embodiment, the control mechanism may also be placed on or in the vicinity of the handles 156 to facilitate the control of the device by the user. As such, the exemplary device may present two sets of controls, e.g., one for the user and another for a possible trainer. The system 150 can also include a chair 158. According to an embodiment, the chair 158 can be centered in front of the equipment and is linked to it by rails or any other guiding system. Further, the chair 158 can allow for the proper distance between the user and the equipment to be set as desired. It can also be moved up and down to adjust to the patient's height as well as the exercise being performed. Further, the chair 158 can include straps (not shown) to keep the user's head and body in the ideal position for the exercises. Further, the system 150 can include an enclosure that keeps the exemplary device protected/encased while it is not in use.

According to an embodiment, the system 150 can perform the same functions as the system 40 as well as the device 1 but with mechanisms that can substitute the work of the arms and hands of the user. For example, spring systems, gears, CV joints, condylar joints, weights, rails, cables and tension control systems can be used to provide resistance for the use of the device as well as mimic the work done by the arms and hands of the user. Further, the resistance system chosen can be controlled electronically or manually. The user may be able to access all necessary control on a front panel. Further, computer and other electronics can be applied to the equipment to help maximize its efficiency and performance. For example, robotic arms and hands can be used to perform the above.

Figure 15:
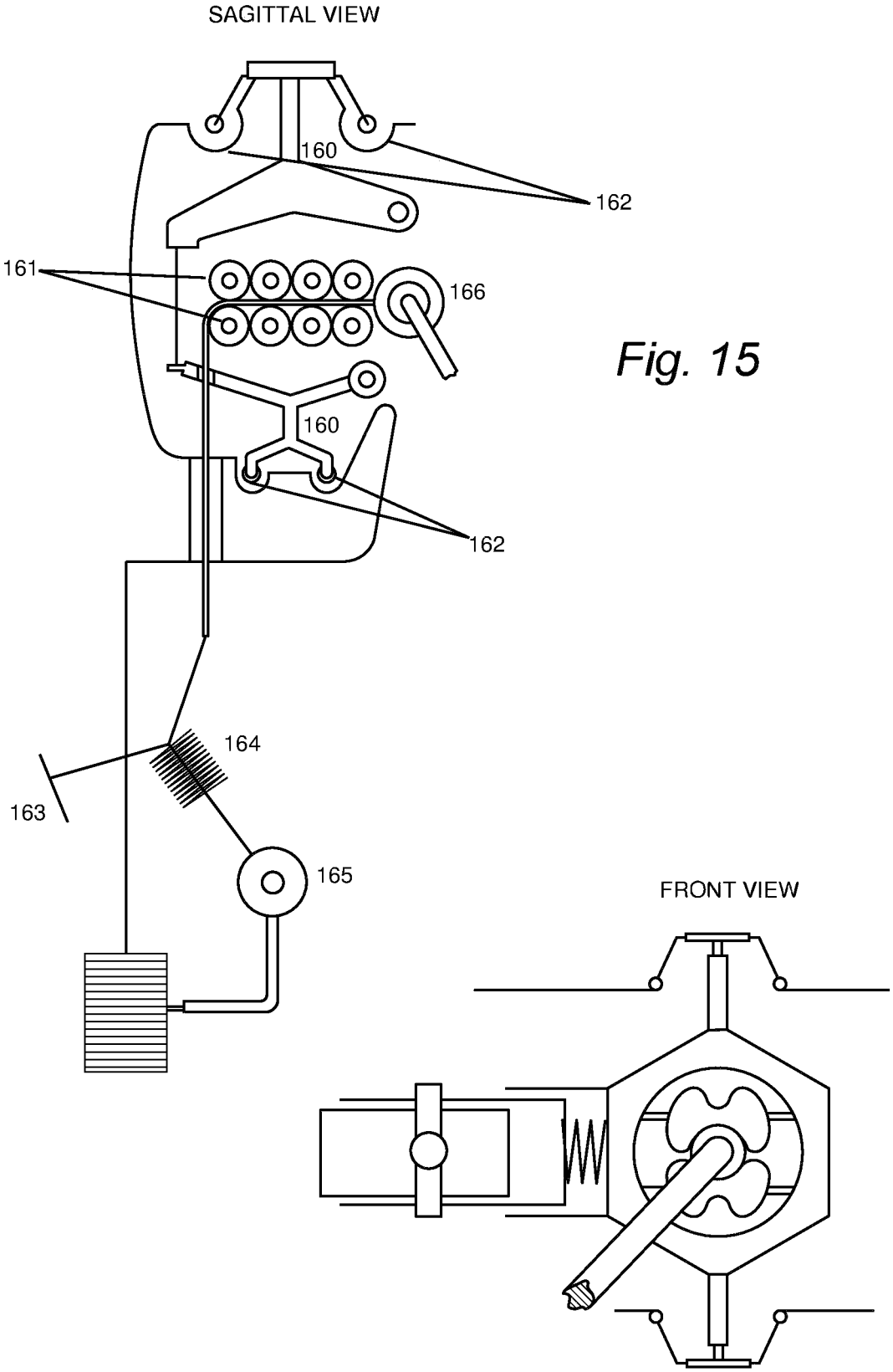
FIG. 15 includes sagittal and front views view of a junction box in the exercise system of FIG. 14.

FIG. 15 illustrates sagittal and front views, respectively, of the junction box 154. As depicted in the figure, each junction box 154 includes sets of cables 160. According to an embodiment, one set of cables 160 is located above a rolling mechanism 161 that runs on rails 162, while the other set of cables 160 is located below the rolling mechanism 161. The movement of the cables 160 permits the device to expand, allowing the modiolus holders 44 to secure both corners of the mouth. Further, the rolling mechanism 161 allows for the cable 160 connected a CV joint 166 (or any other type of joint) to move when pulling forces are applied to the device. On its distal end, it is attached to springs and/or weights, and at its mesial end, it is connected to the CV joint 166. According to an embodiment, the CV joints 166 help the device to be angled, mimicking the movement of the hands and arms of the user. Further, as the cables 160 exit each junction box 154 though the back, they are then joined together in connection 163 via a spring 164. After the spring connection, the cables 160 can be run through a pulley 165 that can be connected to weights or any other means of resistance. According to an embodiment, all the forces applied to the function of the equipment can be connected to a control panel that can be used by the user or the potential trainer. It can also function mechanically or electronically.

A display panel to monitor the status of the user's performance may also be placed connected to, or otherwise incorporated into any of the aforementioned exercise systems. Further, according to an embodiment, at least one pressure sensor can be included in any of the modiolus holders described above. The pressure sensors can measure the amount of pressure being applied by the modiolus holders on the modiolus muscle of the user as well as the pressure being applied by the modiolus muscles on the modiolus holders. According to an embodiment, the results of the pressure sensors as well as other performance metrics associated with the device can be transmitted to the display panel via a communication network. The communications network can be comprised of, or may interface to any one or more of, for example, the Internet, an intranet, a Local Area Network (LAN), a Wide Area Network (WAN), a Metropolitan Area Network (MAN), a storage area network (SAN), a frame relay connection, an Advanced Intelligent Network (AIN) connection, a synchronous optical network (SONET) connection, a digital T1, T3, E1 or E3 line, a Digital Data Service (DDS) connection, a Digital Subscriber Line (DSL) connection, an Ethernet connection, an Integrated Services Digital Network (ISDN) line, a dial-up port such as a V.90, a V.34 or a V.34bis analog modem connection, a cable modem, an Asynchronous Transfer Mode (ATM) connection, a Fiber Distributed Data Interface (FDDI) connection, a Copper Distributed Data Interface (CDDI) connection, or an optical/DWDM network. The communications network can also comprise, include or interface to any one or more of a Wireless Application Protocol (W AP) link, a Wi-Fi link, a microwave link, a General Packet Radio Service (GPRS) link, a Global System for Mobile Communication (GSM) link, a Code Division Multiple Access (CDMA) link or a Time Division Multiple Access (TDMA) link such as a cellular phone channel, a GPS link, a cellular digital packet data (CDPD) link, a Research in Motion, Limited (RIM) duplex paging type device, a Bluetooth radio link, or an IEEE 802.11-based radio frequency link. Communications networks can further comprise, include or interface to any one or more of an RS-232 serial connection, an IEEE-1394 (Firewire) connection, a Fibre Channel connection, an infrared (IrDA) port, a Small Computer Systems Interface (SCSI) connection, a Universal Serial Bus (USB) connection or another wired or wireless, digital or analog interface or connection.

As is evident from the above disclosure, the present invention has applications in an array of fields including, but not limited to, dentistry, plastic surgery, general exercise, physical therapy, and physical education.

The above-described device and methods of implementing the device are meant to be illustrative, and alternative devices and methods are within the scope of this disclosure. For example, device 1 may be used in other fields besides facial and neck stimulation, for example in gynecology or proctology.

What is claimed is:

1. An exercise device for exercising face and neck muscles, the exercise device comprising:

a pair of bars;

a pair of modiolus holders; and a pair of handles;

a stop extending between the pair of handles, the stop comprising a spring between the pair of handles configured to provide a degree of flexibility for the pair of handles to move relative to one another, wherein:

the pair of bars are attached via a rotatable connection, wherein respective distal ends of the pair of bars are configured to be separate from one another, wherein the stop is between the rotatable connection and the distal ends of the pair of bars, wherein the pair of modiolus holders are attached to respective proximal ends of the pair of bars, wherein the pair of handles are attached to the distal ends of the pair of bars, respectively, and wherein the pair of handles and the pair of modiolus holders are symmetrical to each other relative to a central line of symmetry of the exercise device, and wherein each of the pair of handles includes an inner surface having at least one indentation configured to receive a finger.

2. The exercise device of claim 1, wherein the pair of modiolus holders each comprise a proximal end of the modiolus holder and a distal end of the modiolus holder, the distal end of each modiolus holder of the pair of modiolus holders comprises a thumb portion and a hand portion, a distal end of the hand portion and a distal end of the thumb portion extending further distally from the rotatable connection than an anterior-posterior groove.

3. The exercise device of claim 2, wherein the anterior-posterior groove extends between the thumb portion and the hand portion and extends distally in both a posterior direction and in an anterior direction from the hand portion and the thumb portion towards the rotatable connection, and the anterior-posterior groove is configured to contact a corner of a mouth of the user.

4. The exercise device of claim 3, wherein the anterior-posterior groove extends further distally in a posterior direction than in an anterior direction.

5. The exercise device of claim 1, wherein each modiolus holder of the pair of modiolus holders includes a first part and a second part extending in a proximal direction, wherein the first part and the second part are joined by a convex groove that projects downwardly on both sides.

6. The exercise device of claim 1, wherein each modiolus holder of the pair of modiolus holders includes a first part and a second part, wherein the second part is longer and has a larger surface area than the first part.

7. The exercise device of claim 1, further comprising a pressure sensor configured to measure an amount of pressure applied by at least one of the pair of modiolus holders, wherein the pressure sensor is configured to transmit data from the exercise device.

8. The exercise device of claim 1, further comprising a force gauge, wherein the force gauge is configured to transmit data from the exercise device.

9. The exercise device of claim 1, wherein the spring is configured to maintain separation of the pair of handles.

10. The exercise device of claim 1, wherein the spring is configured to maintain separation of the pair of modiolus holders.

* * * * *